US005078272A

United States Patent [19]

Combs

[11] Patent Number: 5,078,272

[45] Date of Patent: Jan. 7, 1992

[54] HEXAGONAL PACKAGE FOR SHIPPING FLUORESCENT LAMPS AND OTHER FRAGILE TUBULAR PRODUCTS

[75] Inventor: Kenneth Combs, Warrensville Heights, Ohio

[73] Assignee: General Electric Company, Schenectady, N.Y.

[21] Appl. No.: 667,116

[22] Filed: Mar. 11, 1991

Related U.S. Application Data

[63] Continuation-in-part of Ser. No. 500,424, Mar. 28, 1990, Pat. No. 5,005,705.

[51] Int. Cl.[5] ..... B65D 81/02; B65D 85/42

[52] U.S. Cl. ..... 206/586; 206/419; 206/443

[58] Field of Search ..... 206/419, 420, 418, 443, 206/446, 586, 588, 589, 591, 592, 594, 521; 229/9, 19, 23 BT, 110

[56] References Cited

U.S. PATENT DOCUMENTS

| | | | |
|---|---|---|---|
| 944,616 | 12/1909 | Jenkins | 206/418 |
| 1,008,963 | 11/1911 | Ekermeyer . | |
| 1,256,031 | 2/1918 | Miller, Jr. | 206/223 X |
| 1,392,791 | 10/1921 | Pettee | 206/586 X |
| 1,701,059 | 2/1929 | Andrews | 229/110 X |
| 1,821,692 | 9/1931 | Copeland | 206/586 |
| 1,850,329 | 3/1932 | Metzger | 206/594 X |
| 2,564,729 | 8/1951 | Sheperd | 206/419 |
| 2,653,708 | 9/1953 | Spalding | 206/446 |
| 2,828,902 | 4/1958 | Ringler | 206/594 X |
| 2,838,173 | 6/1958 | Emery | 206/419 |
| 2,867,367 | 1/1959 | Butz | 206/586 |
| 3,163,312 | 12/1964 | Chaplin | 206/419 X |
| 3,223,234 | 12/1965 | Weiss . | |
| 3,572,574 | 3/1971 | Mears | 206/586 X |
| 3,648,920 | 3/1972 | Stump | 206/586 X |
| 4,724,960 | 2/1988 | Goodrum et al. | 206/586 X |
| 5,005,705 | 4/1991 | Combs | 206/586 |

FOREIGN PATENT DOCUMENTS

| | | | |
|---|---|---|---|
| 256037 | 8/1926 | United Kingdom . | |
| 297571 | 9/1928 | United Kingdom | 206/418 |

*Primary Examiner*—Bryon P. Gehman
*Attorney, Agent, or Firm*—Edward M. Corcoran; Stanley C. Corwin; Fred Jacob

[57] ABSTRACT

A package for shipping fluorescent lamps comprising a rectangularly shaped first carton closed at both ends and containing said lamps within and being disposed inside a hexagonally shaped second carton or sleeve. The longitudinal axes of both cartons are parallel and two opposing sides of the first carton are parallel to and in proximate contact with the inside surface of two respective opposing sides of the second carton inside the second carton. The package contains two triangularly shaped and opposing cavities each of which contains a triangular shaped spacer to prevent rotation of the first carton within the second carton.

9 Claims, 4 Drawing Sheets

HEXAGONAL PACKAGE FOR SHIPPING FLUORESCENT LAMPS AND OTHER FRAGILE TUBULAR PRODUCTS

CROSS-REFERENCE TO RELATED APPLICATION

This application is a continuation-in-part application of copending U.S. Ser. No. 07/500,424 filed on Mar. 28, 1990, now U.S. Pat. No. 5,005,705.

BACKGROUND OF THE INVENTION

Field of the Invention

The present invention relates to a package for shipping fragile tubular articles such as fluorescent lamps and other similarly shaped fragile articles. More particularly, the present invention relates to a package for shipping fragile tubular articles such as fluorescent lamps, glass tubing and the like comprising a first carton being rectangularly-shaped and containing a plurality of said articles within which have their longitudinal axes parallel to the longitudinal axis of said first carton, with said first carton being disposed within a hexagonally-shaped second carton with the longitudinal axis of both cartons parallel and with two opposing sides of the first carton being in proximate contact with two respective opposing sides of said second carton, inside said second carton, to form two triangular-shaped cavities inside said second carton and wherein both of said triangular-shaped cavities each contains a triangularly-shaped spacer to prevent rotation of said first carton inside said second carton and to provide additional rigidity, strength, stiffness and impact resistance to said package.

Background of the Disclosure

A variety of boxboard or fiberboard cartons generically referred to as cardboard or corrugated cartons have been designed and used to protect various types of electric lamps as is well known both to consumers and to those skilled in the art. Fluorescent lamps are usually packaged in an inexpensive paper carton or sleeve that provides little if any protection to the lamp contained therein from breaking due to crushing forces or to impact with foreign objects or to stresses applied perpendicular to the longitudinal axis of the tube-shaped lamp. When these lamps are shipped in bulk from a manufacturer or distributor, they are generally shipped in rectangular-shaped boxboard cartons closed at both ends. In one method of shipping where the lamps are intended for sale or distribution to the consumer and industrial market, each lamp is inserted into a relatively thin, generally square-shaped paper or boxboard sleeve and then placed in a carton in the form of layers of lamps. A typical carton for a standard four foot fluorescent lamp is rectangular-shaped having dimensions of about ten and a half inches on two of the opposing sides and eight and three-quarter inches on the other two opposing sides and will contain five layers of six lamps in each layer for a total of thirty lamps. Where the lamps are intended for commercial use, instead of each lamp being inserted into a separate sleeve, each layer of lamps rests on a molded paper pulp tray type of spacer which separates the lamps and layers from each other.

Because of their long length, eight foot fluorescent lamps are packed generally fifteen in a carton so that the carton is not too bulky for safe handling. Such cartons generally contain three layers of five lamps in each layer separated by molded paper pulp tray types of spacers. For a T12 fluorescent lamp having an outer diameter of one and one-half inches, such cartons are nominally 10 inches×5 inches×95 inches long. A typical carton for fifteen eight foot fluorescent lamps is shown as carton 10 in FIG. 1. FIG. 1(*b*) shows carton 10 in cross-section containing three rows of five fluorescent lamps 12 each, wherein each row and each lamp is separated by means of trays or spacers 14. Carton 10 is closed or sealed at both ends by means of conventional end panels (not shown) glued together as is well known to those skilled in the art. Such cartons have to be handled and shipped extremely carefully due to the fragile nature of the contents and the long length of the carton. Forces applied to the top, bottom or sides of the carton will act to compress and crush the fluorescent lamps contained therein. The lamp-containing carton has little, if any, resistance to crushing or flexing and particularly impact forces and any such forces applied to the carton will break all or a portion of the lamps contained inside, depending on the magnitude of the force. To make a carton of material strong and rigid enough to contain such lamps and to be flexible and resistant to both compressive and impact forces, thereby minimizing breakage of the lamps contained therein, has not been economically feasible.

Accordingly, such cartons of lamps and other similarly shaped, fragile articles such as glass and ceramic rod and tubing, etc., must be handled and shipped very carefully which, in the past, has been done by private carrier. This is fairly expensive and in order to minimize costs requires coordination of shipping orders and extra careful handling by the shipper to try to minimize breakage. It would result in a substantial cost savings if common carrier shippers could be employed to transport such lamps and other similar devices to various parts of the country from their source of manufacture or from distributors. Common carriers will not accept for shipment cartons of lamps and other similar articles packaged as shown in FIG. 1, because of the high breakage rate of the contents. Accordingly, there is a substantial need for an inexpensive and effective means of packaging such lamps and similarly shaped fragile articles for shipment via common carrier from manufacturing and distribution locations to customers.

SUMMARY OF THE INVENTION

The present invention relates to a package for shipping fragile tubular articles such as fluorescent lamps or other similarly shaped fragile articles which comprises a rectangularly-shaped first carton containing a plurality of said articles within which have their longitudinal axes parallel to the longitudinal axis of said first carton, with said first carton being disposed within a hexagonally shaped second carton, with the longitudinal axis of both cartons being substantially parallel coincident and with two opposing sides of said first carton being in proximate contact with two respective opposing sides of said second carton, inside said second carton, to form two triangular-shaped cavities inside said second carton and wherein both of said triangular shaped cavities each contains a triangularly-shaped spacer to prevent rotation of said first carton within said second carton. In the context of the invention rectangular is meant to include square. In addition to preventing rotation of the first carton within the second carton the spacers will preferably provide additional strength and impact resistance to said package.

Independent laboratory tests made on packages of the present invention, as depicted in FIG. 2, wherein the first or inside carton contained fifteen fluorescent lamps, each having a nominal outside diameter of one and a half inches and a length of eight feet and wherein the two diametrically opposing, internal, triangular cavities each contained a triangularly-shaped, boxboard spacer, showed that packages according to this invention were substantially superior to the package depicted in FIG. 1 in terms of preventing or minimizing lamp breakage in impact tests. Moreover, packages of this invention containing eight foot fluorescent lamps have been approved for use in commerce by a common carrier.

DETAILED DESCRIPTION

Figure 1A:
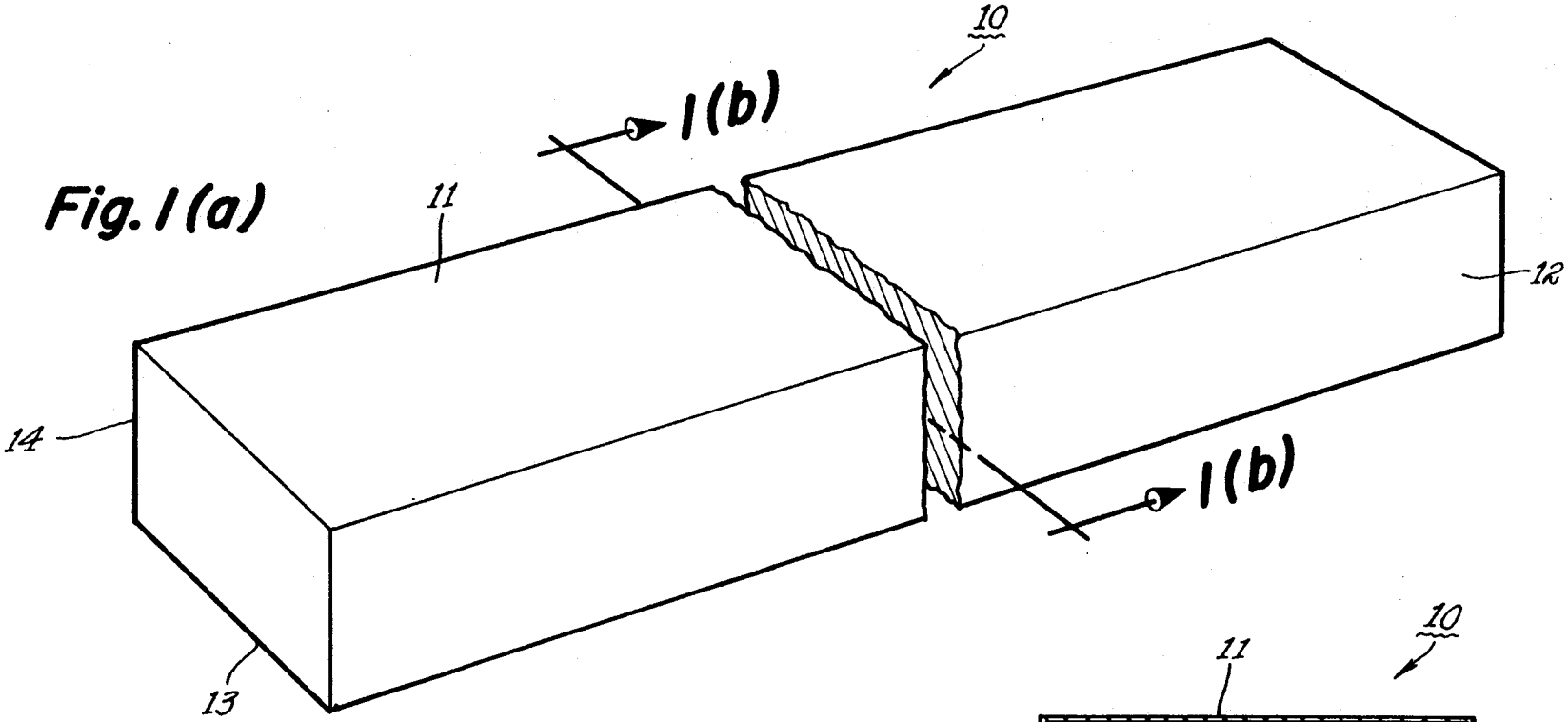
FIGS. 1(*a*) and 1(*b*) schematically illustrate a simple carton containing fifteen fluorescent lamps, each having a length of about eight feet and a nominal outside diameter of one and a half inches.
Figure 1B:
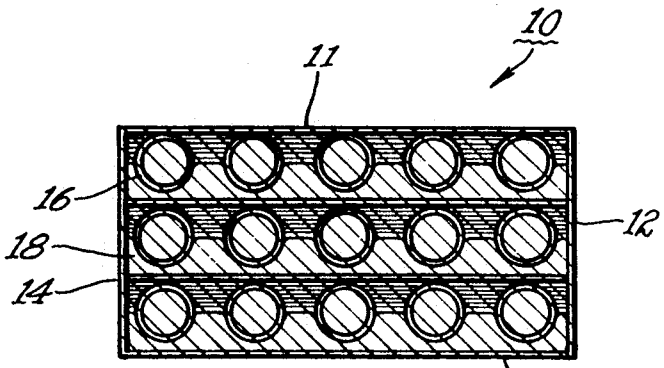

FIGS. 1(*a*) and 1(*b*) schematically illustrate a boxboard carton 10 sealed at both ends by means of end flaps glued together (not shown) and having four sides 11, 12, 13 and 14. FIG. 1(*b*) illustrates a section taken across carton 10 showing lamps 16 separated by spacers 18. Spacers 18 are molded paper pulp trays similar to molded paper egg cartons.

Figure 2A:
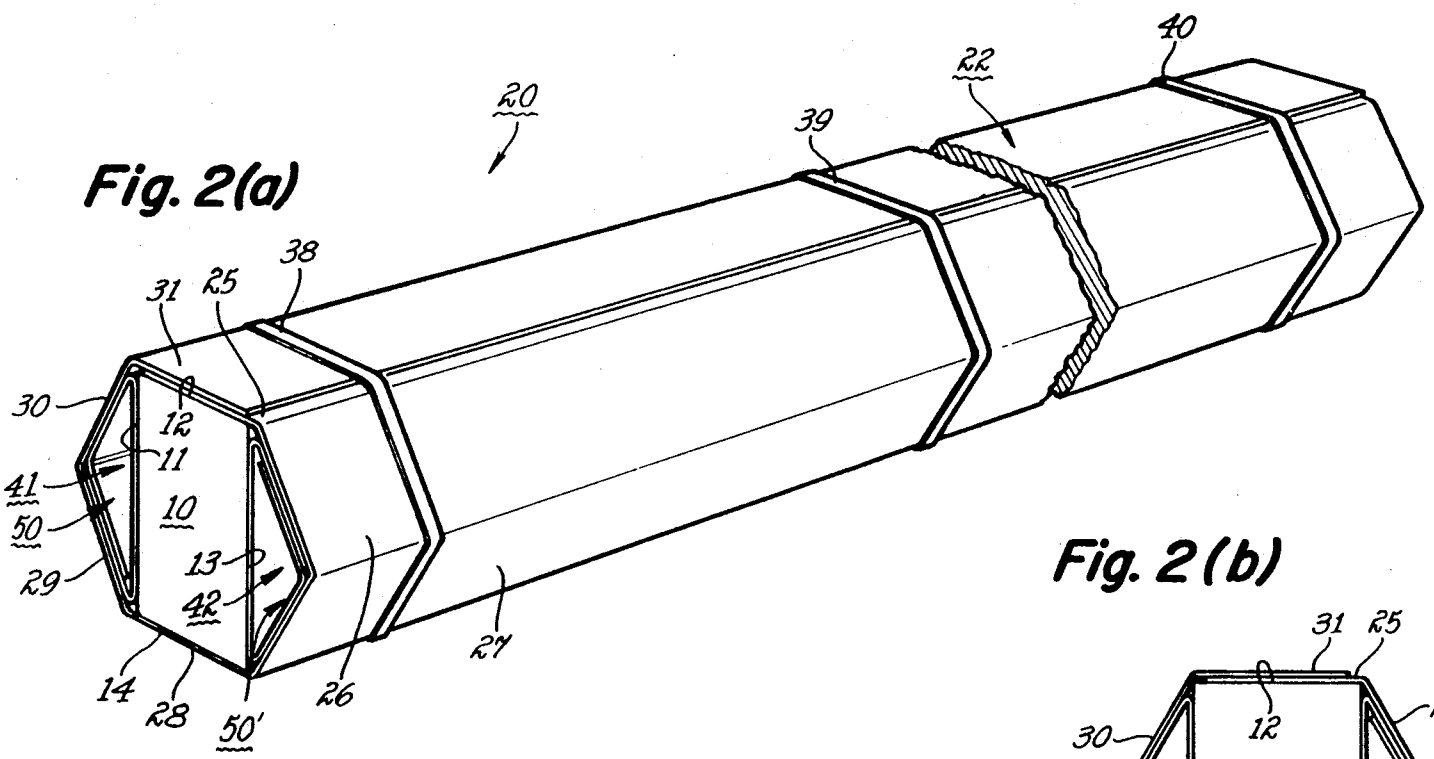
FIGS. 2(*a*) and 2(i b) illustrate both a perspective view and a schematic end view of an embodiment of a package according to the present invention.
Figure 2B:
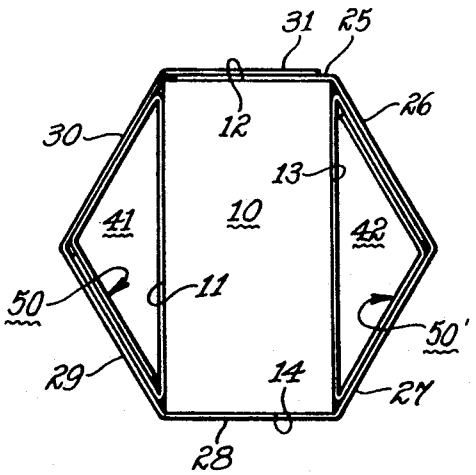
Figure 3:
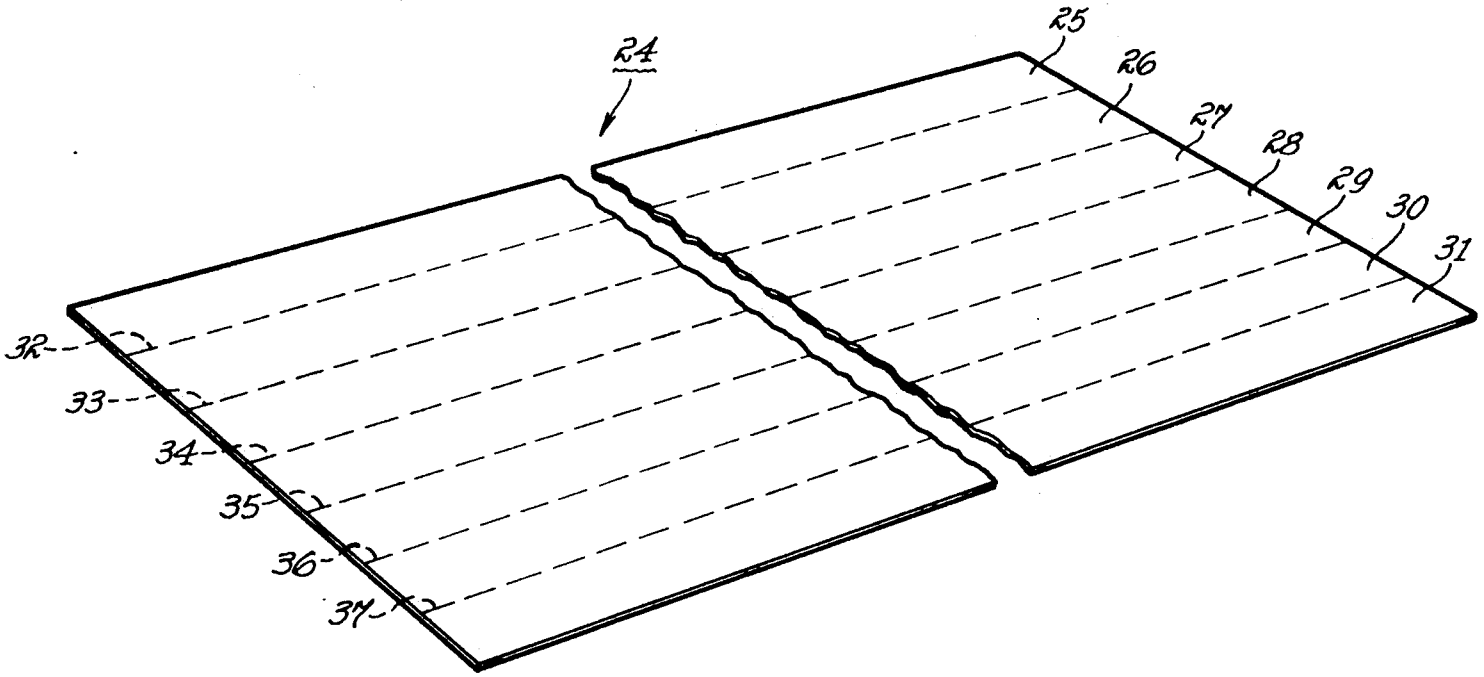
FIG. 3 is a schematic view of an embodiment of a unitary boxboard useful in forming the outer carton or sleeve of the package of this invention.

Turning now to FIGS. 2(*a*) and 2(*b*) there is shown in perspective view of an embodiment of a package 20 according to the present invention wherein carton 10 which is illustrated in FIG. 1(*a*) as containing fifteen lamps 16 separated by spacers 18 is shown disposed inside carton or container 22 so that the two opposing smaller side panels 12 and 14 of carton 10 are in proximate contact with the inside surface of two respective opposing sides 25 and 28 of carton 20, inside carton 22 to form two triangular-shaped cavities 41 and 42. Carton or container 22 is a hexagonal shaped boxboard sleeve open at both ends (although it could be closed if desired) formed from folding and wrapping a rectangular boxboard blank 24 around carton 10 and securing same by means of plastic or steel wrapping bands or straps, as they are sometimes called, 38, 39 and 40. Blank 24 is shown in FIG. 3 as consisting of a series of seven consecutively arranged, rectangular-shaped panels 25, 26, 27, 28, 29, 30 and 31 hingedly connected along parallel fold lines 32, 33, 34, 35, 36 and 37. Folding the blank 24 along the fold lines forms the panels. In FIGS. 2(*a*) and 2(*b*), panel 31 is shown overlapping panel 25. In one embodiment of this invention wherein the width of the side walls of carton 10 are 8½ inches and 4 15/16 inches, panels 27, 28, 29 and 30 are all 5 5/16 inches wide, with panels 25, 26 and 31 being 5¼, 5 7/16 and 5⅛ inches wide, respectively. Thus, the width of the seven panels of sleeve or carton 22 are about the same. However, departures from this are permitted within the scope of this invention. Thus, panels 26 and 27 and 29 and 30 can be of somewhat different widths from each other and from panels 25, 28 and 31. Similarly, the amount of overlap of panel 31 may be varied as desired.

Triangular spacers 50 and 50′ are shown inserted into triangular cavities 41 and 42, respectively. Carton 10 is sealed at both ends in the usual fashion by means of two opposing pairs of glue flaps (not shown), one pair of which overlaps the other as is known to both laymen and to those skilled in the art. Sealing both ends of carton 10 is important in order to provide rigidity and strength. Further, the spacers 50 and 50′ are illustrated as being dimensioned so that the three sides thereof which are in proximate contact with the inside surface of panels 26, 27, 29 and 30 and the outside surfaces of sides 11 and 13 of carton 10 are about the same lengths as those of the respective sides of said panels cartons which they are in contact with to avoid rotation or shifting of carton 10 inside carton or sleeve 22.

Figures 4A, 4B:
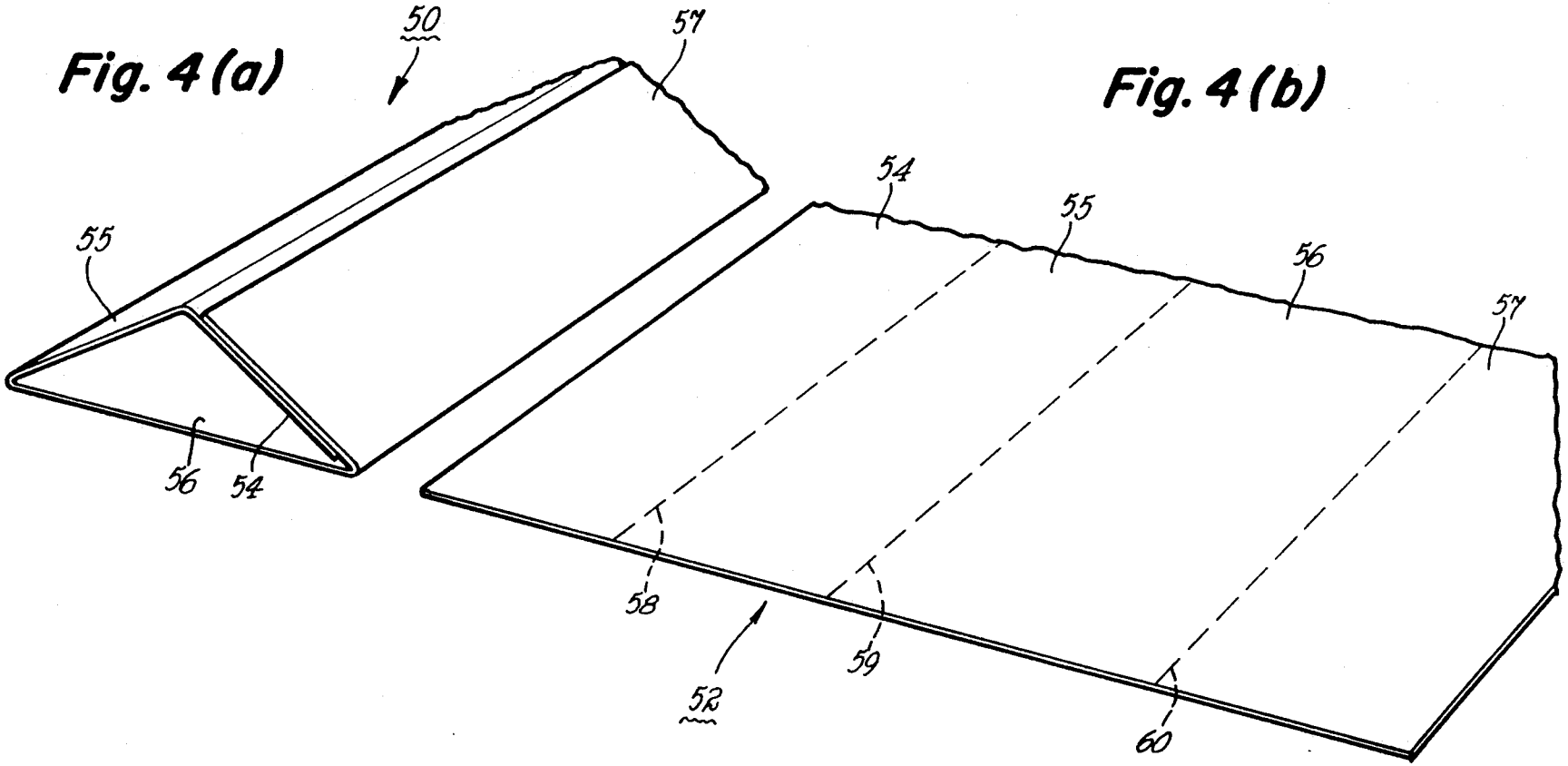
FIGS. 4(*a*) and 4(*b*) schematically illustrate a triangular spacer useful in the practice of the invention and a boxboard blank from which the spacer is formed.

FIGS. 4(*a*) and 4(*b*) illustrate in schematic fashion a typical construction for a triangular boxboard spacer useful in the invention (i.e., 50 or 50′). Thus, spacer 50 is shown consisting of a series of four consecutively arranged, rectangular-shaped panels 54, 55, 56 and 57. Turning to FIG. 4(*b*) blank 52 from which spacer 50 is formed is a unitary blank consisting of a series of four consecutively arranged, rectangular-shaped panels 54, 55, 56 and 57 hingedly connected along parallel fold lines 58, 59 and 60. FIG. 4(*a*) shows the spacer 50 folded in the form of a triangle for use with the present invention wherein panel 57 almost completely overlaps panel 54. It should be noted that panel 57 does not have to be of the the same width as panel 57 but may be smaller and still achieve the desired result. However, it is preferred for strength and rigidity of the overall package 20 that panel 57 be almost about as wide as panel 54. In this embodiment of FIG. 4(i a), positioning of the spacer in the triangular space does not effect its performance. It is possible to use a three sided triangular spacer with no panel overlap, but this arrangement is not as strong or as rigid.

Those skilled in the art will know that the spacers employed with the present invention can be made out of other materials such as a foamed plastic material (i.e., styrofoam), wood, metal, plastic, etc.

EXAMPLE

A number of standard cartons according to FIG. 1 were made from fiberboard or boxboard (commonly known as cardboard), being approximately eight feet long (97⅞″) and having external dimensions of 8½ inches on two opposing sides and 4 15/16 inches on the other two respective opposing sides. Each carton contained fifteen fluorescent lamps (three rows of five lamps in each row) having a nominal length of eight feet, an outer diameter of one and one-half inches and containing molded paper pulp spacers as shown in FIG. 1 for separating the lamps and preventing their touching each other. The cartons each possessed four end flaps on each end (not shown) folded over in a conventional manner and glued or adhesively bonded to make a sealed carton. The sealed ends also provide rigidity to the carton. Some of these packages were inserted as shown in FIG. 2 into a hexagonal fiberboard box or sleeve approximately eight feet long open at each end and with seven sides each dimensioned as set forth above and strapped around carton 10 by three plastic straps. Two triangular spacers according to FIG. 4(*a*)

also made of boxboard were employed as shown in FIGS. 2(*a*) and 2(*b*). The boxboard was of a double wall construction with rated specifications having a bursting test of 200 pounds per square inch with a minimum combination weight facings of 84 pounds per thousand square feet. A number of these boxes and packages according to the present invention were submitted to an independent testing laboratory for compression and drop testing.

The compression tests were made by resting the carton 10 or package 20 on two pieces of wood (2×4) placed about 15 inches in from both ends of the carton or package and another piece of (2×4) wood placed on top at the middle and a load applied.

For the carton 10 of the prior art as shown in FIG. 1(*b*), the average load and deflection causing lamp tube breakage was 445 pounds and 0.72 inches deflection and 402 pounds and 1.40 inches, depending on whether the load was placed against a narrow (i.e., 12 or 14) side or a wide side, respectively. The average number of lamps broken per test was 7.2 and 6.3, respectively. In contrast, for the package of the present invention the average load and deflection causing breakage in four separate tests were 638 pounds and 1.74 inches with the load placed against either of panels 31 or 28 as shown in FIGS. 2(*a*) and 2(*b*) and 301 pounds and 2.39 inches with the load placed against either of panels 26, 27, 29 or 30 as shown in FIGS. 2(*a*) and 2(*b*). The average number of lamps broken per test averaged 3.3 and 13.3, respectively. It should be noted that a major common carrier will not accept packages weighing more than 70 pounds, so that these tests do not tell the whole story. Actual common carrier shipping tests have proved the superiority of the package of the invention.

Drop tests were performed in which the package and carton orientation in the drop test was the same as in the compression test except that blocks were not used. In the drop test, the package or carton was placed on a flat surface and raised 26 inches at one end and dropped. An average of 7.7 lamps were broken with the prior art carton and 5 per package employing the present invention.

What is claimed is:

1. A package for shipping fragile tubular or rod-shaped articles, which comprises a first carton being rectangularly-shaped and containing a plurality of said articles within, with the longitudinal axes of said articles being parallel to the longitudinal axis of said first carton, with said first carton being disposed within a hexagonally-shaped second carton or sleeve with the longitudinal axis of both cartons being substantially parallel and coincident and with two of the opposing sides of said first carton being in proximate contact with two respective opposing sides of said second carton inside said second carton to form two triangular-shaped cavities inside said second carton and wherein each of said two triangular-shaped cavities contains a triangular-shaped spacer of about the same dimensions as one of said cavities to prevent rotation of said first carton within said second carton and also to provide additional stiffness and rigidity to said package.

2. The package of claim 1 wherein said first carton is sealed at both ends.

3. The package of claim 2 wherein said first and second cartons are made of boxboard.

4. The package of claim 3 wherein said spacers are made of boxboard.

5. A package for shipping fluorescent lamps having a longitudinal axis which comprises a first carton being rectangularly-shaped and containing a plurality of said lamps within, with the longitudinal axes of said lamps being parallel to the longitudinal axis of said first carton, with said first carton being disposed within a hexagonally-shaped second carton or sleeve with the longitudinal axis of both cartons being substantially parallel and coincident and with two opposing sides of said first carton being in proximate contact with two respective opposing sides of said second carton inside said second carton, to form two triangular-shaped cavities inside said second carton and wherein each of said two cavities contains a triangular-shaped spacer of about the same dimensions as one of said cavities to prevent rotation of said first carton within said second carton and also to provide additional stiffness and rigidity to said package.

6. The package of claim 5 wherein said first carton is sealed at both ends.

7. The package of claim 6 wherein said first and second cartons are made of boxboard.

8. The package of claim 7 wherein said spacers are made of boxboard.

9. A package for shipping fragile articles, which comprises a rectangularly-shaped first carton containing a plurality of said articles and being disposed within a hexagonally-shaped second carton with the longitudinal axis of both cartons being substantially parallel and coincident and with two opposing sides of said first carton being in proximate contact with two respective opposing sides of said second carton inside said second carton to form two triangular-shaped cavities inside said second carton, wherein each of said two cavities contains a triangular-shaped spacer of about the same dimensions as one of said cavities to prevent rotation of said first carton within said second carton and also to provide additional stiffness and rigidity to said package.

* * * * *